United States Patent [19]

Zeilinger

[11] Patent Number: 4,759,087

[45] Date of Patent: Jul. 26, 1988

[54] CLOSURE DEVICE FOR A SHOWER CURTAIN

[75] Inventor: Alan Zeilinger, Cleveland, Ohio

[73] Assignee: Magic American Corporation, Cleveland, Ohio

[21] Appl. No.: 59,019

[22] Filed: Jun. 8, 1987

[51] Int. Cl.[4] ..... A47K 3/22

[52] U.S. Cl. ..... 4/605; 4/608; 4/558; 4/559; 16/87.2; 24/462; 24/DIG. 11; 160/392

[58] Field of Search ..... 4/605, 607–610, 4/614, 609, 558, 559, 557; 16/87.2; 24/462, 303, DIG. 11; 160/349, 392, 330, DIG. 16

[56] References Cited

U.S. PATENT DOCUMENTS

| | | | |
|---|---|---|---|
| 2,049,061 | 7/1936 | Hoegger, Sr. | 160/391 X |
| 2,148,401 | 2/1939 | Ellis, Jr. | 4/608 |
| 2,204,928 | 6/1940 | Culver | 210/199 |
| 2,303,502 | 12/1942 | Rorks | 4/608 |
| 2,712,354 | 7/1955 | Margolies | 160/330 |
| 3,205,547 | 9/1965 | Riekse | 24/243 |
| 3,365,684 | 1/1968 | Seemke et al. | 335/302 |
| 3,639,919 | 2/1972 | White | 4/608 X |
| 3,808,610 | 5/1974 | Mortensen | 4/558 |
| 3,879,806 | 4/1975 | Armstrong | 4/610 |
| 4,077,072 | 3/1978 | Dezura | 4/558 |
| 4,333,187 | 6/1982 | Schuler | 4/608 |

*Primary Examiner*—Henry K. Artis

*Attorney, Agent, or Firm*—Renner, Otto, Boisselle & Sklar

[57] ABSTRACT

A two-piece closure device for a shower curtain includes a wall attachment strip having a pre-applied adhesive backing for adhering such strip to a vertical wall surface adjacent an end edge of the shower curtain, and a curtain attachment clip adapted to be fastened to an end edge of the shower curtain in alignment with the wall attachment strip by folding a flap on one side of the curtain attachment clip over until a projecting rib portion on the flap moves into locking engagement in a channel on the curtain attachment clip with the curtain edge disposed therebetween. The wall attachment strip and curtain attachment clip have releasably interfitting male and female portions for releasably connecting the two pieces together.

18 Claims, 1 Drawing Sheet

CLOSURE DEVICE FOR A SHOWER CURTAIN

BACKGROUND OF THE INVENTION

This invention relates generally, as indicated, to a closure device for a shower curtain, and more particularly, to a closure device for use in releasably attaching one or both end edges of a shower curtain in place against the respective shower stall or tub walls to prevent water from splashing between the shower curtain edges and walls onto the adjacent wall surfaces or onto the floor during showering.

It is common practice to provide shower stalls or tubs which have an overhead shower with a shower curtain that can be drawn across the open side of the shower stall or tub during showering to prevent water from splashing out. However, oftentimes the end edges of the shower curtain do not remain close up against the adjacent end walls during use, leaving a slight gap therebetween which allows water to splash out onto the adjacent wall and floor surfaces. Not only can a wet floor be a potential safety hazard, but excessive water on the outer wall surfaces and floor can cause structural damage, and will promote undesirable mold and mildew growth.

Closure devices of various types have previously been used for temporarily attaching the end edges of a shower curtain to the adjacent wall surfaces during showering which have met with varying degrees of success. However, there is a continuing need for a simplified closure device which is not only effective in maintaining a relatively watertight seal between the curtain end edges and adjacent wall surfaces, but is also relatively easy to install and operate.

SUMMARY OF THE INVENTION

With the foregoing in mind, it is a principal object of this invention to provide a shower curtain closure device of simplified construction which is relatively quick and easy to install without the need for any tools and the like.

Another object is to provide such a closure device which is relatively easy to operate and is effective in holding one or both end edges of a shower curtain in place against the adjacent wall surfaces during showering.

Still another object is to provide such a closure device which is relatively easy to operate with one hand, either to attach one or both end edges of a shower curtain to the adjacent end walls, or to release same.

These and other objects of the present invention may be achieved by providing a relatively simple two-piece closure device, one piece comprising a wall attachment strip which is easily attached to the vertical wall surface adjacent an end edge of the shower curtain, and the other piece comprising a curtain attachment clip which is easily clipped to such shower curtain edge, such pieces having releasably intefitting male and female portions for releasably connecting the two pieces together.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
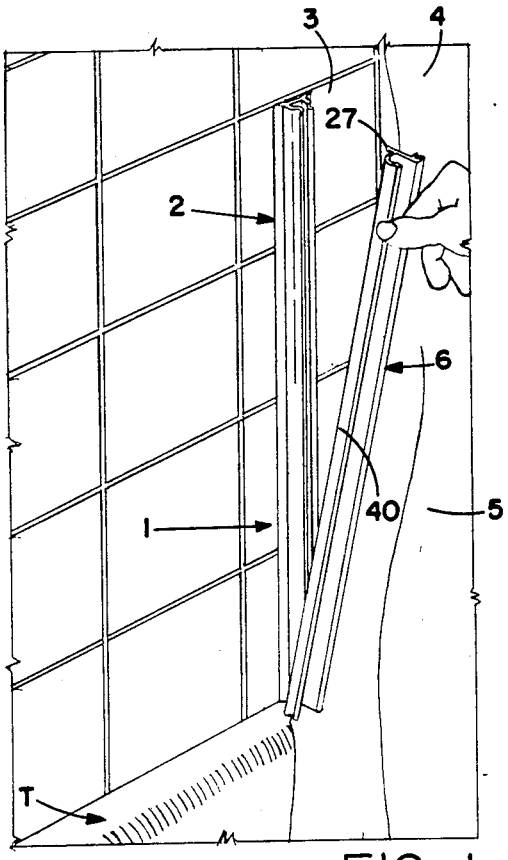
FIG. 1 is a perspective view of a two-piece closure device in accordance with this invention comprising a curtain attachment clip shown attached to one end edge of a shower curtain, and a wall attachment strip shown attached to an adjacent wall surface in vertical alignment with the curtain attachment clip.

Referring now in detail to the drawings, and initially to FIG. 1, there is shown a preferred form of shower curtain closure device 1 in accordance with this invention which is of a simple two-piece construction, including a wall attachment strip 2 shown attached to a vertical wall surface 3 adjacent one end edge 4 of a shower curtain 5, and a curtain attachment clip 6 shown attached to such curtain edge. As described in greater detail hereafter, the two closure pieces 2, 6 have releasable interfitting male and female portions which permit such pieces to be easily connected together to maintain the shower curtain end edge up against the adjacent wall surface during showering and subsequently released as desired. Both pieces are desirably made of a suitable plastic material which imparts the desired rigidity and/or flexibility thereto as described hereafter.

Figure 2:
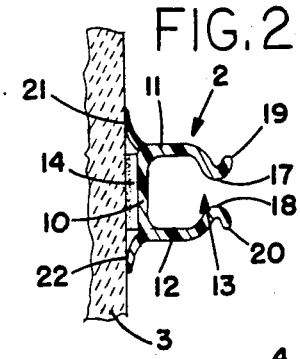
FIG. 2 is an enlarged transverse section through the wall attachment strip of FIG. 1 showing how the wall attachment strip is adhered to the adjacent wall surface.
Figure 4:
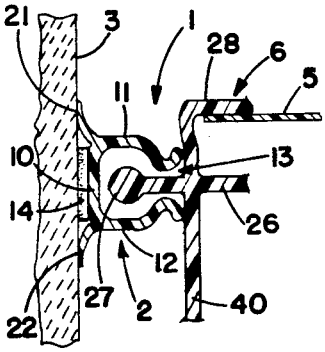
FIG. 4 is a fragmentary transverse section through the closure device of FIG. 1 showing how the curtain attachment clip is releasably connected to the wall attachment strip.
Figure 5:
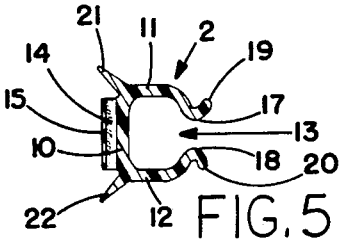
FIG. 5 is an enlarged transverse section through the wall attachment strip prior to being adhered to the adjacent wall surface.

As best seen in FIGS. 2, 4 and 5, the wall attachment strip 2 is generally channel-shaped in section and includes a base portion 10 and two spaced apart side walls 11, 12 defining a channel or groove 13 therebetween. Base portion 10 is generally flat to permit substantially flat engagement up against the wall 3 (see FIGS. 2 and 4). Also, a flexible waterproof adhesive 14 such as an acrylic adhesive is desirably pre-applied to the back side of the base portion for use in adhering the strip 2 to such wall, with a release film 15 covering the adhesive (see FIG. 5) to protect same until peeled away just prior to installation.

The sides 11, 12 of the wall attachment strip 2 are somewhat flexible and are bowed inwardly toward each other at 17, 18 adjacent the outer edges 19, 20 thereof so that the spacing therebetween is narrower adjacent such edges than near the base for a purpose to be subsequently described. Also, such outermost edges 19, 20 are desirably turned outwardly to impart greater rigidity or stiffness to the strip edges. Flexible feathered lip seals 21, 22 are also desirably provided along each side of the base portion 10 which form a watertight seal with the wall surface 3 when the strip 2 is adhered thereto as shown in FIGS. 2 and 4, thus protecting the adhesive 14 against contamination by dirt and water, and providing a smooth joint between the wall attachment strip and adjacent wall surface which is relatively easy to clean.

The curtain attachment clip 6 includes a generally flat strip member 26 having an overall length substantially corresponding to that of the wall attachment strip 2. Along one edge of member 26 is a bead 27 having a diameter slightly greater than the spacing between the sides 11, 12 of the wall attachment strip 2 at the most constricted points 17, 18 therebetween to provide a snap fit of the bead within the wall attachment strip channel 13.

Figure 3:
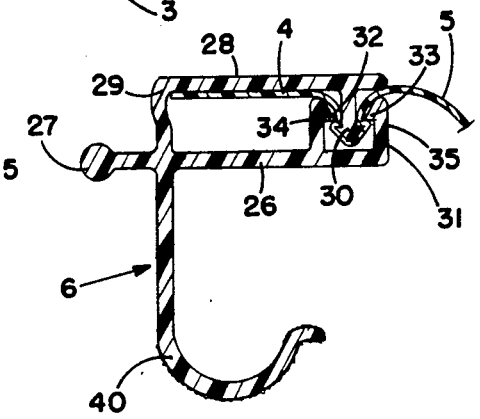
FIG. 3 is an enlarged transverse section through the curtain attachment clip of FIG. 1 showing how such clip is attached to the end edge of a shower curtain.
Figure 6:
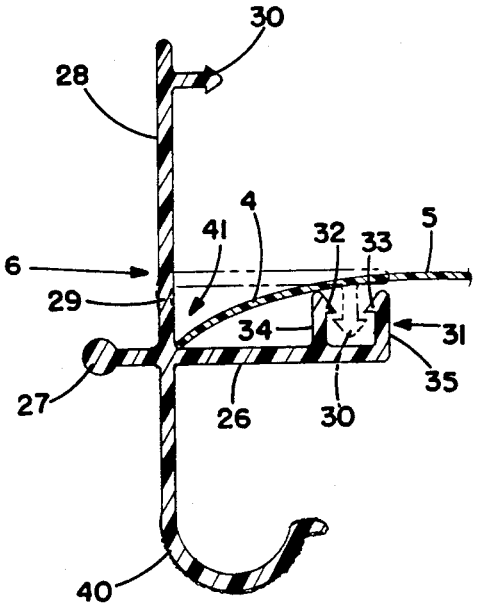
FIG. 6 is an enlarged transverse section through the curtain attachment clip prior to attachment to an end edge of a shower curtain.

To attach the curtain attachment clip 6 to the end edge 4 of the shower curtain 5, a foldable flap 28 is provided on one side of the strip member 26 closely spaced from the bead 27. The flap 28 is foldable (bendable) along a line 29 slightly outwardly spaced from the strip member 26, and has a projecting rib portion 30 on the side of the flap facing away from the bead 27 (see FIGS. 3 and 6). Also, a narrow channel 31 is provided on the same side of the member 26 as the flap 28, but in spaced relation from the point at which the flap is connected to the member 26 a distance substantially corresponding to the spacing between the fold line 29 and projecting rib portion 30, whereby when the flap is folded over in the direction of the channel 31, the projecting rib portion 30 will be swung into alignment with the channel for ease of insertion therein. The projecting rib portion 30 is desirably generally arrow-shaped as shown, and the channel 31 interior desirably has barb-like ribs 32, 33 on opposite sides 34, 35 thereof to strongly resist pull-out of the rib portion 30 when inserted into the channel during attachment of the clip to an end edge 4 of the shower curtain 5 as described hereafter.

Extending outwardly from the side of the strip member 26 opposite the flap 28 is a curved handle 40 which may be gripped by one hand to facilitate engagement of the bead 27 on the curtain attachment clip 6 in the channel 13 of the wall attachment strip 2 as shown in FIG. 4. This is best done by applying pressure at the top of the handle and running the hand down the length of the handle to secure the curtain attachment strip to the wall attachment strip over its entire length. To release the curtain attachment clip from the wall attachment strip, all that is necessary is to apply a simple pulling force to the handle which causes the bead on the curtain attachment strip to disengage from the wall attachment strip channel.

The closure device 1 should be installed from the inside of the shower stall or tub T. The first step during installation is to close the shower curtain 5 to determine the point on the wall 3 where the wall attachment strip 2 is to be attached. The entire surrounding wall area should be thoroughly cleaned to ensure that the wall attachment strip will securely bond thereto. A small vertical mark may be placed on the wall where the wall attachment strip is to be applied.

Before adhering the wall attachment strip to the wall, it is preferable to connect the wall attachment strip 2 and curtain attachment clip 6 together. Then the release film 15 is removed from the adhesive 14 and the wall attachment strip 2 is pressed firmly against the wall 3, running pressure up and down the length of the wall attachment strip to ensure good adhesion. Combining the two pieces 2, 6 together prior to adhering the wall attachment strip in place ensures that the wall attachment strip will be straight on the wall.

Next the curtain attachment clip 6 should be removed from the wall attachment strip 2 and the shower curtain 5 closed to determine the height at which the curtain attachment clip should be attached to the end edge of the curtain. To make such attachment, the curtain end edge 4 is simply inserted into the groove 41 formed by the flap member 28 and strip member 26 and the flap member is folded over as shown in phantom lines in FIG. 6 so that the projecting rib portion 30 can readily be pressed into the channel 31, forcing a portion of the curtain 5 into the channel along with the rib, thus securing locking the curtain in place. It will help in attaching the curtain attachment clip to the curtain if the curtain is held taut in the closed position by temporarily taping the curtain to the tub or shower stall using masking tape or the like.

When the curtain attachment clip 6 is properly attached to the curtain 5, the bead 27 on the curtain attachment clip should be in line with the wall attachment strip 2 with the handle 40 on the inside of the curtain as shown in FIG. 1. The curtain end edge may then be held in place against the adjacent wall surface 3 by inserting the bead 27 on the curtain attachment clip 6 into the channel of the wall attachment strip 2. This is most easily done by applying pressure to the top of the handle 40 and running pressure down the length of the handle. The sides 11, 12 of the wall attachment strip are sufficiently flexible to permit the bead 27 on the curtain attachment clip to be easily inserted into the channel and removed therefrom, yet sufficiently rigid to retain the two pieces together until sufficient pulling force is applied to the curtain attachment clip to disengage the bead from the wall attachment strip. This may be accomplished simply by applying a slight pulling force on the handle or by pulling the curtain open. However, it is recommended that the handle be used to avoid possible tearing of the curtain.

Although the length of the closure device 1 may vary within limits, each of the two pieces 2, 6 should be of sufficient length, for example, 18 inches, to make sure that enough curtain length is held up against the wall to maintain a relatively watertight joint therebetween. Also, the wall attachment strip itself desirably has a maximum height of approximately 5/16 inch, and the bottom of the flap 28 and handle 40, which are both desirably approximately 1/16 inch thick, are desirably substantially flush up against the outer edges of the wall attachment strip when the two pieces are connected together as shown in FIG. 4.

When the curtain attachment clip is inserted into the wall attachment strip, the closure device itself of course prevents water from passing between it and the adjacent wall surface. Both above and below the closure device the curtain end edge will generally hug the adjacent wall surfaces. When the closure device 1 is used with a tub, the lower end of the wall attachment strip 2 may be placed generally flush with the top surface of the tub as shown in FIG. 1.

From the foregoing, it will now be apparent that the closure device of the present invention provides a relatively simple and effective means for keeping one or both end edges of a shower curtain close up against the adjacent end walls during showering so that the floor and adjacent wall surfaces remain safe, dry and mildew free. The closure device opens and closes at the touch of a finer, and is quickly and easily installed without the need for any tools.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A closure device for a shower curtain comprising a wall attachment strip adapted to be mounted on a vertical wall surface adjacent an end edge of a shower curtain, a curtain attachment clip adapted to be attached to such curtain end edge, and means for releasably connecting said curtain attachment clip to said wall attachment strip, said curtain attachment clip comprising a strip member having a foldable flap protruding from one side of said strip member defining a groove with said one side for receipt of such end edge of such curtain, and securing means on said flap and said one side of said strip member for securing such curtain between said flap and strip member upon folding said flap over into locking engagement with said strip member.

2. The closure device of claim 1 wherein said securing means comprises a projecting rib portion on said flap, and a channel on said one side of said strip member, said flap being foldable to bring said projecting rib portion into alignment with said channel for insertion of said projecting rib portion into said channel with a portion of the curtain disposed therebetween for locking such curtain in said channel by means of said projecting rib portion.

3. The closure device of claim 1 further comprising a handle protruding from the opposite side of said strip member from said flap.

4. The closure device of claim 1 wherein said wall attachment strip is of generally channel shape including a base portion and a pair of spaced-apart sides, and said curtain attachment clip has an enlarged bead along one edge of said strip member for insertion and removal from between said spaced-apart sides of said wall attachment strip.

5. The closure device of claim 4 wherein said sides of said wall attachment strip are bowed inwardly toward each other adjacent the outer edges so that the spacing between said sides adjacent said outer edges is less than the diameter of said bead on said strip member to provide a snap fit of said bead between said sides of said wall attachment strip.

6. The closure device of claim 5 wherein the outermost edges of said sides of said wall attachment strip are turned outwardly.

7. The closure device of claim 4 wherein said base portion is generally flat for substantial flat engagement up against such vertical wall surface.

8. The closure device of claim 7 further comprising a pre-applied adhesive on the exterior surface of said base portion for adhering said wall attachment strip to such vertical wall surface.

9. The closure device of claim 8 further comprising a release film covering said adhesive to protect said adhesive until said release film is peeled away prior to adhering said wall attachment strip to such vertical wall surface.

10. The closure device of claim 8 further comprising flexible seal means along each side of said base portion which form a watertight seal with the vertical wall surface to protect said adhesive against contamination and provide a smooth joint for ease of cleaning.

11. The closure device of claim 4 wherein said wall attachment strip and curtain attachment clip are of substantially the same length, and said bead on said curtain attachment clip extends substantially the full length thereof for receipt in the channel of said wall attachment strip.

12. The closure device of claim 11 wherein said wall attachment strip and curtain attachment clip are both approximately 18 inches long.

13. A closure device for a shower curtain comprising a wall attachment strip adapted to be secured to a vertical wall surface, a curtain attachment clip adapted to be attached to an end edge of a shower curtain, and means for releasably connecting said curtain attachment clip to said wall attachment strip, said curtain attachment clip comprising a strip member having a flexible flap protruding from one side of said strip member, a projecting rib portion on said flap, and a channel on said one side of said strip member, said flap being foldable to bring said rib portion into alignment with said channel for insertion of said rib portion into said channel with the curtain edge disposed therebetween for locking such curtain in said channel by means of said rib portion.

14. The closure device of claim 13 wherein said flap and said one side of said strip member define a groove for receipt of such end edge of such curtain prior to folding said flap over and inserting said rib portion into said channel to lock such curtain in said channel.

15. The closure device of claim 13 further comprising a handle protruding from the opposite side of said strip member from said flap.

16. The closure device of claim 13 wherein said channel has a pair of spaced-apart sides, with barb-like ribs on the interior of each side to resist pull-out of said projecting rib portion from said channel.

17. The closure device of claim 13 wherein said flap has a fold line in closely spaced relation from said one side of said strip member, and the spacing between said projecting rib portion and said fold line substantially corresponds to the spacing between the point of attachment of said flap to said strip member and said channel, whereby when said flap is folded about said fold line in the direction of said channel, said projecting rib portion will swing into substantial alignment with said channel for ease of insertion of said projecting rib portion into said channel.

18. The closure device of claim 17 wherein said projecting rib portion extends generally perpendicular from the side of said flap facing said channel when said flap is folded over as aforesaid, and said channel extends generally perpendicular from said strip member.

* * * * *